US008985278B2

(12) United States Patent
Xu

(10) Patent No.: US 8,985,278 B2
(45) Date of Patent: Mar. 24, 2015

(54) LUBRICATION SYSTEM HAVING SEGMENTED ANTI-BACKFLOW FEATURE

(75) Inventor: JinQuan Xu, Groton, CT (US)

(73) Assignee: United Technologies Corporation, Hartford, CT (US)

( * ) Notice: Subject to any disclaimer, the term of this patent is extended or adjusted under 35 U.S.C. 154(b) by 182 days.

(21) Appl. No.: 13/606,901

(22) Filed: Sep. 7, 2012

(65) Prior Publication Data

US 2014/0069743 A1 Mar. 13, 2014

(51) Int. Cl.
*F01D 25/18* (2006.01)
*F01D 25/20* (2006.01)

(52) U.S. Cl.
CPC ..... *F01D 25/18* (2013.01); *F01D 25/20* (2013.01)
USPC ..... 184/6.11

(58) Field of Classification Search
CPC ..... F01D 25/18; F01D 25/20
USPC ..... 184/6.11; 137/315.33, 454.2
See application file for complete search history.

(56) References Cited

U.S. PATENT DOCUMENTS

| | | | | |
|---|---|---|---|---|
| 3,049,138 | A * | 8/1962 | Klank, Jr. | 137/38 |
| 4,346,786 | A | 8/1982 | Midgley | |
| 4,630,711 | A | 12/1986 | Levrai et al. | |
| 5,018,601 | A | 5/1991 | Waddington et al. | |
| 5,046,306 | A | 9/1991 | Borre, Jr. | |
| 5,102,379 | A | 4/1992 | Pagluica et al. | |
| 5,121,815 | A | 6/1992 | Francois et al. | |
| 5,167,207 | A | 12/1992 | Gohara | |
| 5,176,039 | A | 1/1993 | Takeuchi et al. | |
| 5,245,820 | A | 9/1993 | Zalewski et al. | |
| 5,251,725 | A | 10/1993 | Barrett, Jr. | |
| 5,472,383 | A | 12/1995 | McKibbin | |
| 6,039,667 | A | 3/2000 | Schunck et al. | |
| 6,223,616 | B1 | 5/2001 | Sheridan | |
| 6,463,819 | B1 | 10/2002 | Rago | |
| 6,929,023 | B2 * | 8/2005 | Whitaker et al. | 137/315.33 |
| 8,020,665 | B2 | 9/2011 | Sheridan et al. | |
| 2002/0083983 | A1 | 7/2002 | Coha et al. | |
| 2003/0230274 | A1 | 12/2003 | Williams et al. | |
| 2004/0025944 | A1 * | 2/2004 | Whitaker et al. | 137/515 |
| 2006/0275144 | A1 * | 12/2006 | Briggs et al. | 417/198 |
| 2008/0116009 | A1 * | 5/2008 | Sheridan et al. | 184/6.4 |
| 2009/0218169 | A1 * | 9/2009 | Kawamura et al. | 184/6.5 |
| 2011/0297485 | A1 | 12/2011 | Sheridan et al. | |
| 2012/0103728 | A1 | 5/2012 | Portlock et al. | |

FOREIGN PATENT DOCUMENTS

| | | |
|---|---|---|
| EP | 2559913 | 2/2013 |

OTHER PUBLICATIONS

Publication of search report for PCT/US2013/058517 dated Aug. 28, 2014.

* cited by examiner

*Primary Examiner* — William E Dondero
*Assistant Examiner* — Robert T Reese
(74) *Attorney, Agent, or Firm* — O'Shea Getz P.C.

(57) ABSTRACT

A tank includes a tank discharge passageway at least partially within a tank body. A segmented anti-back flow structure is mounted adjacent to the tank body and the tank discharge passageway.

14 Claims, 10 Drawing Sheets

LUBRICATION SYSTEM HAVING SEGMENTED ANTI-BACKFLOW FEATURE

BACKGROUND

The present disclosure relates to a lubrication system for a gas turbine engine and, more particularly, to a lubrication system that remains operable in reduced gravity (reduced-G) conditions.

Aircraft gas turbine engines include a lubrication system to supply lubrication to various components. An auxiliary lubrication capability may also be provided so that at least some components can be lubricated under transient conditions. It is also desirable to ensure that at least some components are not starved of lubricant during reduced-G conditions in which acceleration due to gravity, is partially or entirely counteracted by aircraft maneuvers and/or orientation.

SUMMARY

A lubricant tank according to one disclosed non-limiting embodiment of the present disclosure includes a lubricant tank discharge passageway at least partially within a tank body. A segmented anti-back flow structure mounted adjacent to the lubricant tank body and the lubricant tank discharge passageway.

In a further embodiment of the foregoing embodiment, the lubricant tank body and the lubricant tank discharge passageway are defined along a non-linear axis.

In a further embodiment of any of the foregoing embodiments, the segmented anti-back flow structure includes a multiple of walls each of which includes an aperture which extends therethrough.

In the alternative or additionally thereto, the foregoing embodiment, includes at least one tube which extends though at least one of the multiple of walls, the at least one tube extends toward a bottom of the lubricant tank body In the alternative or additionally thereto, the foregoing embodiment, includes at least one of the multiple of walls surround the lubricant tank discharge passageway.

In the alternative or additionally thereto, each of the tubes extends towards an adjacent lower wall.

In the alternative or additionally thereto, each of the multiple of walls surround the lubricant tank discharge passageway.

In a further embodiment of the foregoing embodiment, the lubricant tank discharge passageway includes an opening to allow lubricant transfer between the lubricant tank discharge passageway and the lubricant tank body.

A lubrication system, according to another disclosed non-limiting embodiment of the present disclosure includes a main lubricant tank configured to hold lubricant that is communicated from the main lubricant tank to a component along a first communication path. An auxiliary lubricant tank configured to hold lubricant that is communicated from the component to the auxiliary lubricant tank along a second communication path, the first communication path separate from the second communication path. An auxiliary lubricant tank discharge passageway at least partially within the auxiliary lubricant tank, the auxiliary lubricant tank discharge passageway includes an opening to permit lubricant transfer between the auxiliary lubricant tank and the auxiliary lubricant tank discharge passageway. A segmented anti-back flow structure mounted adjacent to the auxiliary tank and the auxiliary lubricant tank discharge passageway.

In a further embodiment of any of the foregoing embodiments, the opening is a multiple of perforations.

In the alternative or additionally thereto, each of the multiple perforations have an area that decreases toward a bottom of the auxiliary lubricant tank discharge passageway.

In a further embodiment of any of the foregoing embodiments, the auxiliary lubricant tank and the auxiliary lubricant tank discharge passageway are defined along a non-linear axis.

In the alternative or additionally thereto, the segmented anti-back flow structure includes a multiple of walls each of which includes a tube which extends therethrough.

In the alternative or additionally thereto each of the tubes extends toward a bottom of the auxiliary lubricant tank.

In the alternative or additionally thereto, at least one of the tubes extends towards an adjacent lower wall with respect to a bottom of the auxiliary lubricant tank.

A method of reducing lubrication starvation from a lubrication system in communication with a geared architecture for a gas turbine engine, according to another disclosed non-limiting embodiment of the present disclosure includes segmenting an auxiliary lubricant tank defined around an auxiliary lubricant tank discharge passageway.

In a further embodiment of any of the foregoing embodiments, the method includes segmenting the auxiliary lubricant tank with a multiple of walls each of which includes a tube which extends therefrom.

In the alternative or additionally thereto, the multiple of walls are with respect to a bottom of the auxiliary lubricant tank, each of the tubes directed toward the bottom from a respective wall.

In a further embodiment of any of the foregoing embodiments, the method includes orienting the auxiliary lubricant tank and the auxiliary lubricant tank discharge passageway along a non-linear axis.

In the alternative or additionally thereto, the method includes forming an opening in the auxiliary lubricant tank discharge passageway along an inner radius thereof.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
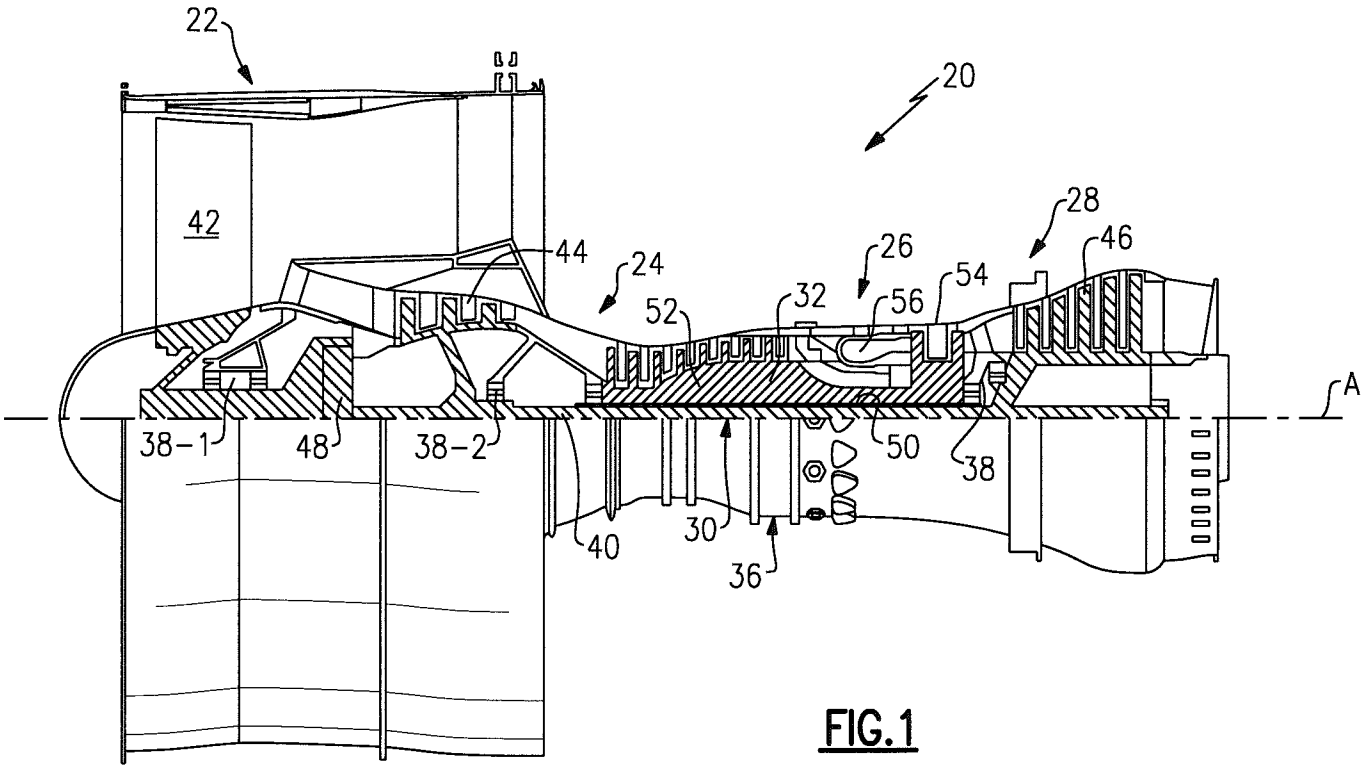
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and low pressure turbine 46. The turbines 54, 46 rotationally drive the respective low spool 30 and high spool 32 in response to the expansion.

The main engine shafts 40, 50 are supported at a plurality of points by bearing structures 38 within the static structure 36. It should be understood that various bearing systems 38 at various locations may alternatively or additionally be provided.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of "T"/518.7$^{0.5}$. in which "T" represents the ambient temperature in degrees Rankine. The Low Corrected Fan Tip Speed according to one non-limiting embodiment of the example gas turbine engine 20 is less than about 1150 fps (351 m/s).

Figure 2:
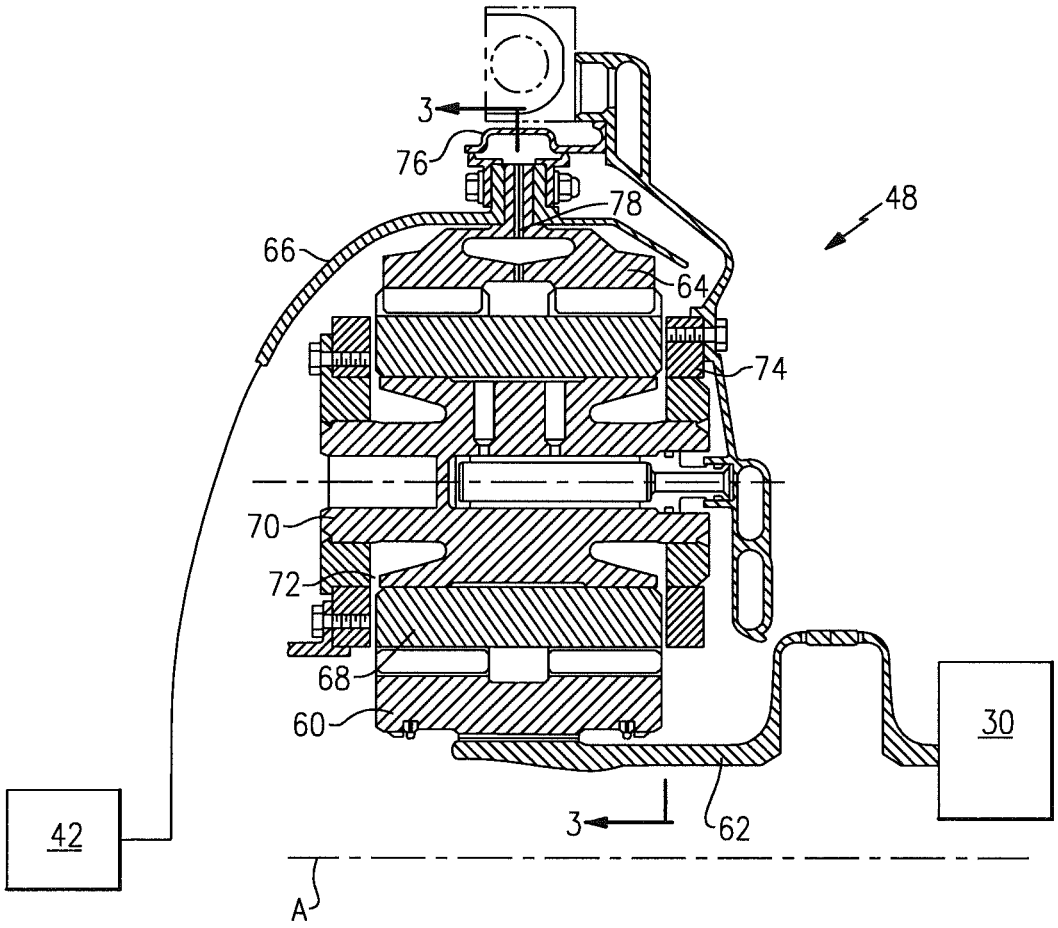
FIG. 2 is a cross sectional side elevation view of a gear train configured as a star system and useful in an aircraft gas turbine engine.

With reference to FIG. 2, the geared architecture 48 includes a sun gear 60 driven by a sun gear input shaft 62 from the low speed spool 30, a ring gear 64 connected to a ring gear output shaft 66 to drive the fan 42, and a set of intermediate gears 68 in meshing engagement with the sun gear 60 and ring gear 64. Each intermediate gear 68 is mounted about a journal pin 70 which are each respectively supported by a carrier 74. A replenishable film of lubricant, not shown, is supplied to an annular space 72 between each intermediate gear 68 and the respective journal pin 70.

A lubricant recovery gutter 76 is located around the ring gear 64. The lubricant recovery gutter 76 may be radially arranged with respect to the engine central longitudinal axis A. Lubricant is supplied thru the carrier 74 and into each journal pin 70 to lubricate and cool the gears 60, 64, 68 of the geared architecture 48. Once communicated through the geared architecture the lubricant is radially expelled thru the lubricant recovery gutter 76 in the ring gear 64 by various paths such as lubricant passage 78.

The input shaft 62 and the output shaft 66 counter-rotate as the sun gear 60 and the ring gear 64 are rotatable about the engine central longitudinal axis A. The carrier 74 is grounded and non-rotatable even though the individual intermediate gears 68 are each rotatable about their respective axes 80. Such a system may be referred to as a star system. It should be appreciated that various alternative and additional configurations of gear trains such as planetary systems may also benefit herefrom.

Many gear train components are able to tolerate lubricant starvation for various intervals of time, however the journal pins 70 may be less tolerant of lubricant starvation. Accordingly, whether the gear system is configured as a star, a planetary or other relationship, it is desirable to ensure that lubricant flows to the journal pins 70, at least temporarily under all conditions inclusive of reduced-G conditions which may arise from aircraft maneuvers and/or aircraft orientation. As defined herein, reduced-G conditions include negative-G, zero-G, and positive-G conditions materially less than 9.8 meters/sec./sec., particularly when such conditions result in an inability of the main lubricant system to satisfy the lubrication requirements of the gears, journal pins and other components requiring lubrication.

Figure 3:
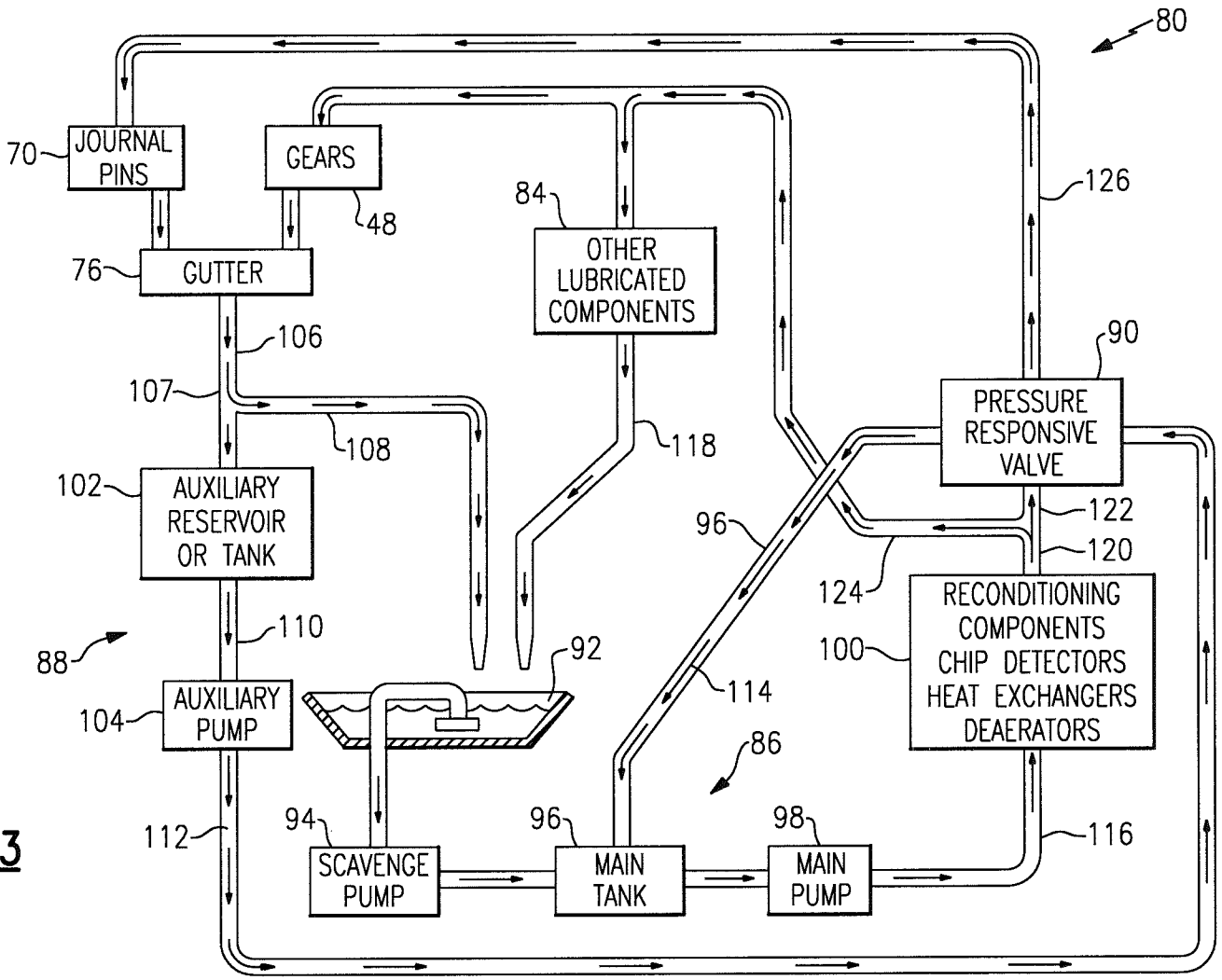
FIG. 3 is a schematic diagram showing a lubrication system in a normal state of operation, i.e. with the lubricant pressure at a normal level.
Figure 4:
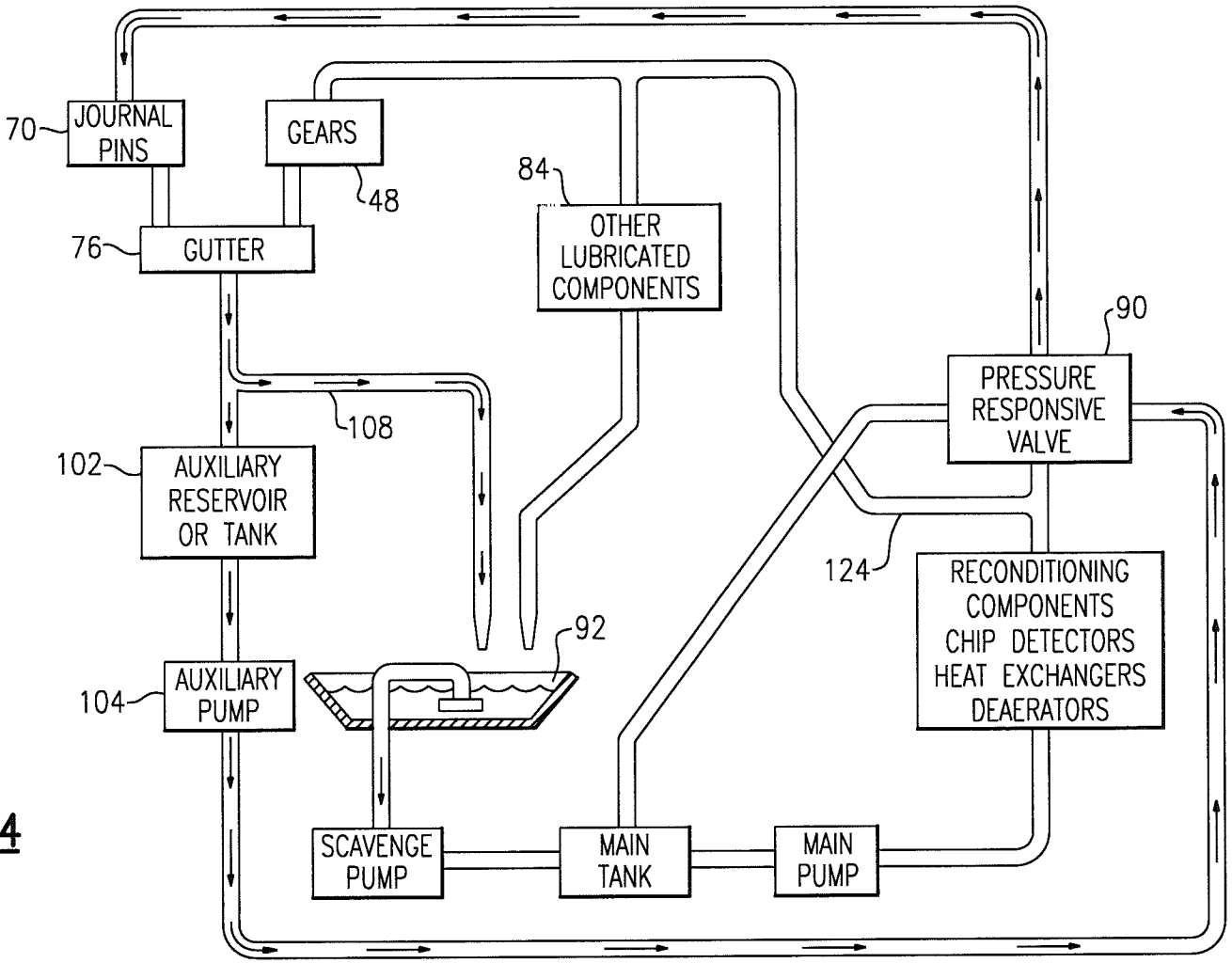
FIG. 4 is a schematic diagram showing the lubrication system of FIG. 3 shortly after the onset of an abnormal state of operation, i.e. with the lubricant pressure lower than a normal level.
Figure 5:
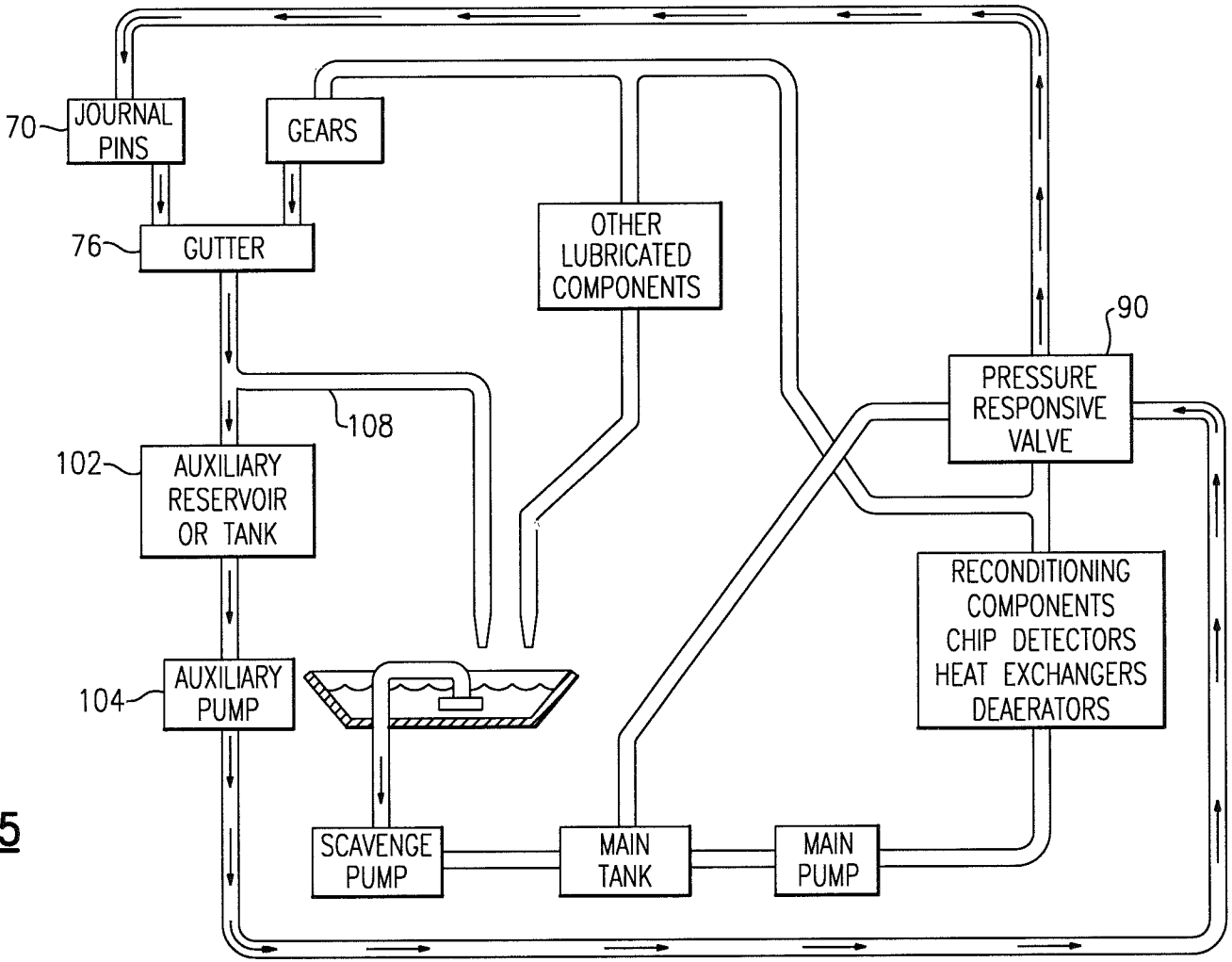
FIG. 5 is a schematic diagram showing the lubrication system at a later time than that shown in FIG. 4.

With Reference to FIGS. 3-5, a lubrication system 80 is schematically illustrated in block diagram form for the geared architecture 48 as well as other components 84 (illustrated schematically) which require lubrication. It should be appreciated that the lubrication system is but a schematic illustration and is simplified in comparison to an actual lubrication system. The lubrication system 80 generally includes a main system 86, an auxiliary system 88 and a pressure responsive valve 90.

The main system 86 generally includes a sump 92, a scavenge pump, a main lubricant tank 96, a main pump 98 and various lubricant reconditioning components such as chip detectors, heat exchangers and deaerators, collectively designated as a reconditioning system 100. The scavenge pump 94 scavenges lubricant from the sump 92, the main lubricant tank 96 receives lubricant from the scavenge pump 94 and the main pump 98 pumps lubricant from the main lubricant tank 96. The main pump 98 is in fluid communication with the pressure responsive valve 90 through the reconditioning system 100.

The auxiliary system 88 generally includes an auxiliary lubricant tank 102 and an auxiliary pump 104. The auxiliary pump 104 is in fluid communication with the pressure responsive valve 90.

Downstream of the gears of the geared architecture 48, lubricant is communicated to the lubricant recovery gutter 76 as rotation of the gears of the geared architecture 48 ejects lubricant radially outwardly into the lubricant recovery gutter 76. An auxiliary lubricant tank supply passageway 106 extends from the lubricant recovery gutter 76 to the auxiliary lubricant tank 102 such that the lubricant recovery gutter 76 serves as a source of lubricant for the auxiliary lubricant tank 102. A bypass passageway 108 branches from the auxiliary lubricant tank supply passageway 106 at a junction 107 and extends to the sump 92 for lubricant which backs up from filled auxiliary lubricant tank 102.

An auxiliary lubricant tank discharge passageway 110 extends from the auxiliary lubricant tank 102 to the auxiliary pump 104 and an auxiliary pump discharge passageway 112 extends from the auxiliary pump 104 to the pressure responsive valve 90. A main lubricant tank return passageway 114 extends from the pressure responsive valve 90 to the main lubricant tank 96 and a lubricant delivery passageway 116 extends from the main pump 98 to the lubricant reconditioning system 100. A lubricant return passageway 118 communicates lubricant from the components 84 to the sump 92.

Downstream of the lubricant reconditioning system 100, a conditioned lubricant passageway 120 branches to the pressure responsive valve 90 through a first conditioned lubricant passageway 122 to the gears of the geared architecture 48 as well as the other components 84 through a second conditioned lubricant passageway 124. A journal lubricant passageway 126 communicates lubricant directly to the journal pins 70 downstream of the pressure responsive valve 90.

The lubrication system 80 is operable in both normal and abnormal states of operation. Those skilled in the art will appreciate that normal operation refers to an expected state of operation in which the lubrication system substantially meets design specification. For example, the normal state is a state of operation in which the system delivers lubricant at the rates, temperatures, pressures, etc. determined by the designer so that the lubricated components, including the gears and journal pins, receive a quantity of lubricant enabling them to operate as intended. Abnormal operation refers to a state of operation other than the normal state.

During normal operation, rotation of the gears of the geared architecture 48 ejects lubricant radially outwardly into the lubricant recovery gutter 76 which communicates lubricant into the auxiliary lubricant tank supply passageway 106 which branches substantially tangentially off the lubricant recovery gutter 76 (FIG. 6) to capture the ejected lubricant. A portion of the lubricant flows through the bypass passageway 108 and returns to the sump 92 while a relatively smaller portion of the lubricant flows into the auxiliary lubricant tank 102 to establish or replenish a reserve quantity of lubricant therein. That is, the lubricant is cycled by the main system 86, and the lubricant in the auxiliary system 88 is continually refreshed.

The auxiliary pump 104 pumps lubricant from the auxiliary lubricant tank 102 to the pressure responsive valve 90 while the scavenge pump 94 extracts lubricant from the sump 92 for delivery to the main lubricant tank 96. The main pump 98 pumps the lubricant from the main lubricant tank 96 to the reconditioning system 100. A majority of the conditioned lubricant flows to the geared architecture 48 and other components 84. The remainder of the conditioned lubricant flows to the pressure responsive valve 90 which, in response to normal pressure in the lubrication system 80, directs this remainder of lubricant to the journal pins 70 through the journal pins lubricant passageway 126 and directs reserve lubricant received from the auxiliary pump 104 back to the main lubricant tank 96 through the main lubricant tank return passageway 114.

With reference to FIG. 4, the lubricant pressure has dropped such that an unsatisfactorily reduced quantity of lubricant flows through the second conditioned passageway 124 after the onset of abnormal operations (e.g. due to a severe leak, clog or malfunction of a system component). In response to the abnormally low pressure, the pressure responsive valve 90 shunts the reserve lubricant received from the auxiliary pump 104 to the journal pins 70 to ensure that the journal pins 70 receive lubricant.

The gears of the geared architecture 48 continue to expel lubricant into the lubricant recovery gutter 76. As with normal operation, a relatively large portion of lubricant flows through the bypass passageway 108 and returns to the sump 92. A relatively smaller portion of the lubricant flows to the auxiliary lubricant tank 102 to at least partially replenish the lubricant that is withdrawn by the auxiliary pump 104.

If the abnormally low lubricant pressure persists, the system reaches the state shown in FIG. 5 in which the quantity of lubricant that circulates through the lubrication system 80 has been reduced to the point that little or no lubricant backs up from the auxiliary lubricant tank 102 and enters the bypass passageway 108. Instead, nearly all of the limited quantity of lubricant flows to the auxiliary pump 104 and eventually back to the journal pins 70. This state of operation persists until the auxiliary lubricant tank 102 is depleted and the flow rate from the lubricant recovery gutter 76 is insufficient for replenishment.

Although effective during normal-G operation, it may be desirable to extend such operability to reduced-G conditions irrespective of whether the lubricant pressure is normal (FIG. 3) or abnormal (FIGS. 4 and 5).

Figure 6:
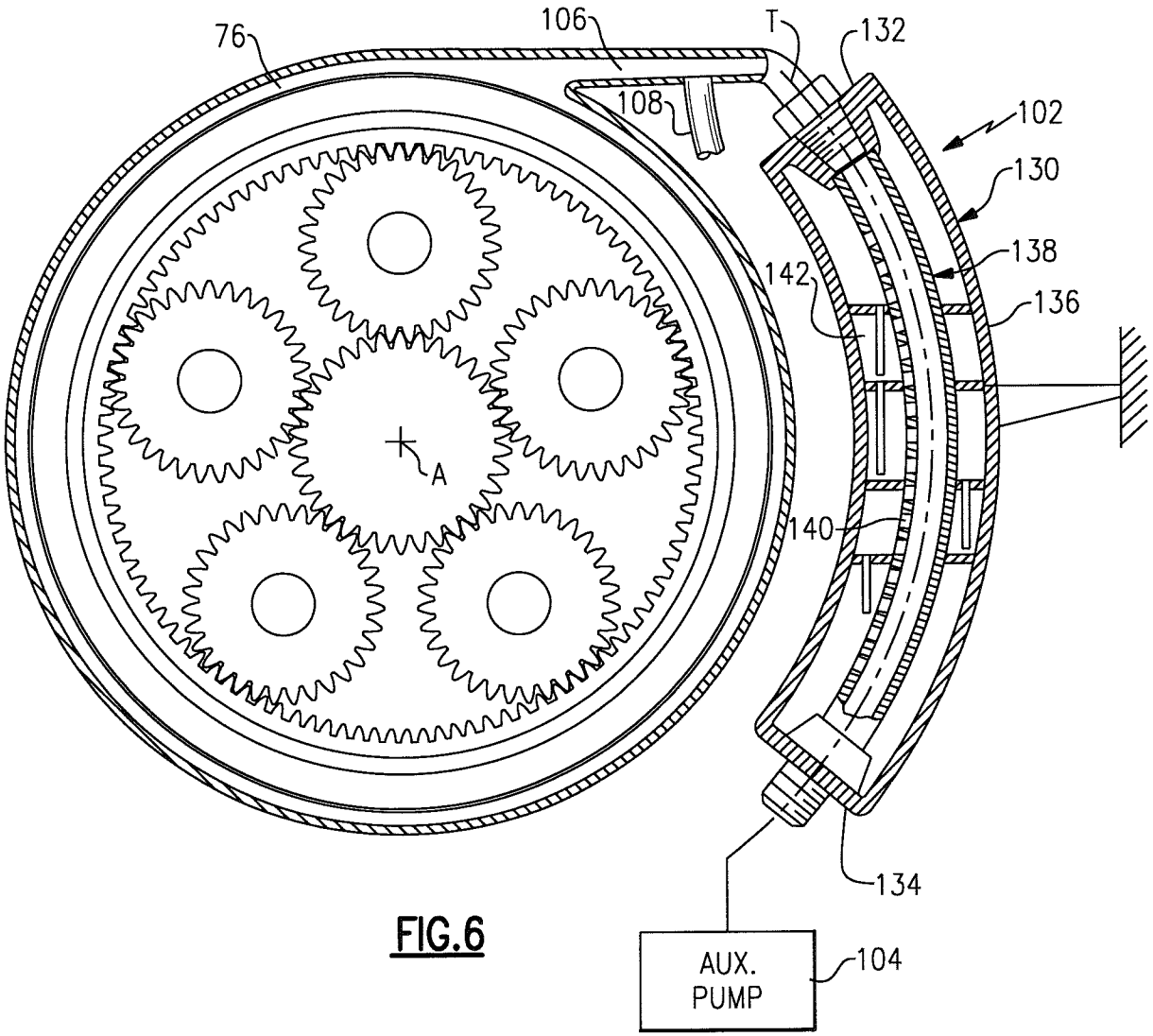
FIG. 6 is a schematic view showing an auxiliary lubricant tank mounted adjacent to a Fan Drive Gear System of a geared turbofan engine according to one non-limiting embodiment.

With reference to FIG. 6, the auxiliary lubricant tank 102 is mounted to a non-rotatable mechanical ground. The auxiliary lubricant tank 102 has an auxiliary lubricant tank body 130 that is generally defined by a top 132, a bottom 134 and a wall 136 which extends therebetween. In one disclosed non-limiting embodiment, the wall 136 may define a cylinder with an arcuate profile to fit at least partially around the lubricant recovery gutter 76. That is, the auxiliary lubricant tank body 130 is defined along an axis T which is non-linear. Alternatively, the auxiliary lubricant tank 102 is generally rectilinear in cross-section or other cross-sectional shapes.

The auxiliary lubricant tank 102 contains an auxiliary lubricant tank discharge passageway 138 often referred to as a "piccolo tube" defined along the axis T. The auxiliary lubricant tank discharge passageway 138 may be a component physically distinct from the auxiliary lubricant tank supply passageway 106 and connected thereto by a fitting or other appropriate connection as shown. Alternatively, the discharge passageway may be an extension of the auxiliary lubricant tank supply passageway 106.

In one disclosed non-limiting embodiment, the auxiliary lubricant tank discharge passageway 138 may define a cylinder with an arcuate profile which generally conforms to the arcuate profile of the auxiliary lubricant tank 102. Alternatively, the auxiliary lubricant tank discharge passageway 138 is generally rectilinear in cross-section or of other cross-sectional shapes either generally equivalent or different than the auxiliary lubricant tank 102. At least a portion of the auxiliary lubricant tank discharge passageway 138 is contained within the auxiliary lubricant tank 102 and communicates with the auxiliary pump 104.

The portion of the auxiliary lubricant tank discharge passageway 138 contained within the auxiliary lubricant tank 102 has an opening 140 along an inner radial boundary of the wall 136 to permit lubricant transfer between the auxiliary lubricant tank 102 and the auxiliary lubricant tank discharge passageway 138. The opening may be of various forms, for example, the opening 140 may be a single opening such as a hole or a slot. In the disclosed, non-limiting embodiment, the opening is a multiple of perforations which decrease in area with a decrease in elevation to at least partially counteract the tendency for the auxiliary pump 104 to extract air from the bottom of the auxiliary lubricant tank 102 during reduced-G operations. It should be appreciated that other baffles or structure may alternatively or additionally be provided.

Figure 7:
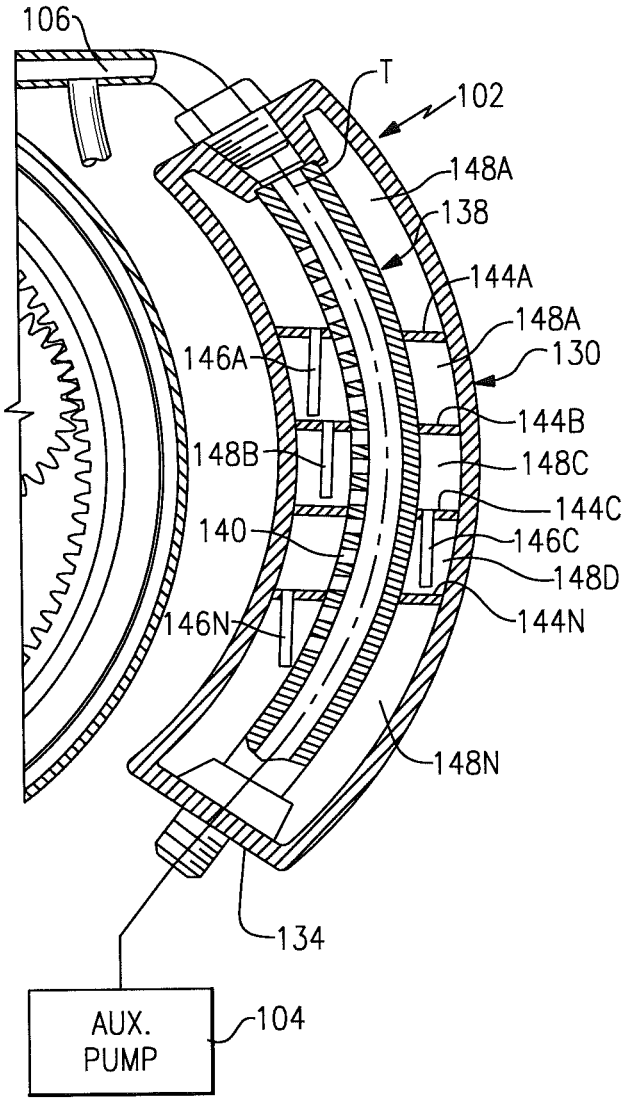
FIG. 7 is an expanded schematic view showing the auxiliary lubricant tank with a segmented anti-back flow structure.

With reference to FIGS. 6 and 7, a segmented anti-back flow structure 142 is located in the auxiliary lubricant tank 102 to surround the auxiliary lubricant tank discharge passageway 138 and still further counteract the tendency for the auxiliary pump 104 to extract air from the bottom of the auxiliary lubricant tank 102 during reduced-G operations. The segmented anti-back flow structure 142 generally includes a multiple of walls 144A-144*n* transverse to the auxiliary lubricant tank discharge passageway 138. It should be understood that although a particular number of walls 144A-144*n* are disclosed in the illustrated embodiment, essentially any number may be utilized.

At least one tube 146A-146*n* extends from each wall 144A-144*n* downward toward the lower wall, such as the next lower wall 144B-144*n* to be close, but not blocked, by that lower wall 144B-144*n*. As used herein, "lower" is with respect to the bottom 134 of the auxiliary lubricant tank 102 and "elevation" refers to distance or height above the bottom 134 of the auxiliary lubricant tank 102 when the system is in the orientation of FIG. 7, i.e. an orientation representative of the engine or aircraft being on level ground or in straight and level flight.

Figure 8:
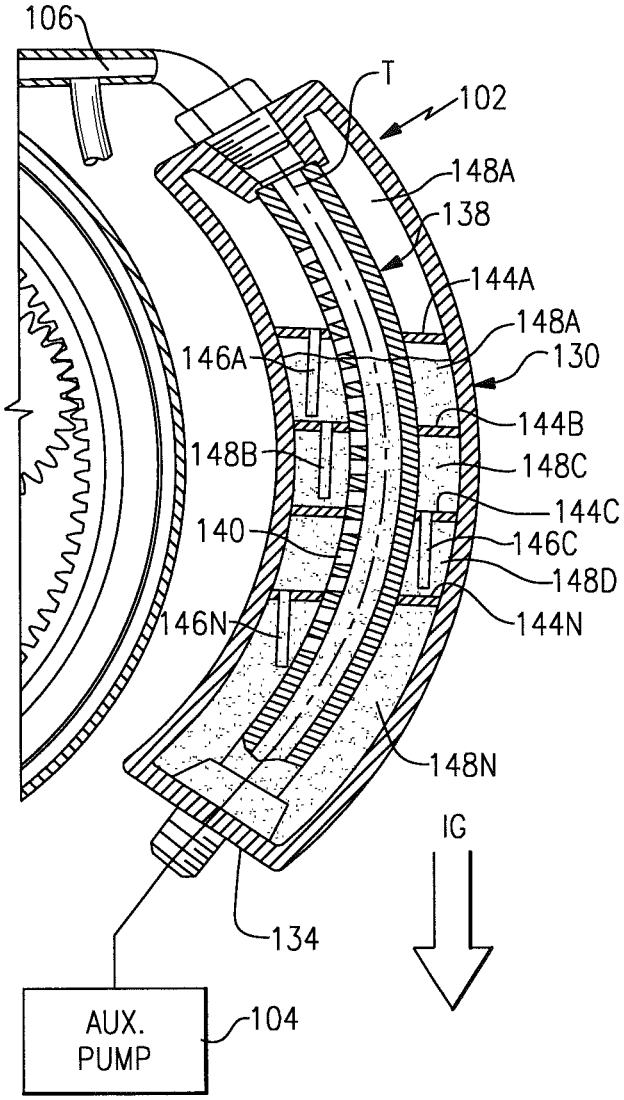
FIG. 8 is an expanded schematic view showing the auxiliary lubricant tank with a segmented anti-back flow structure during an example normal operation.
Figure 9:
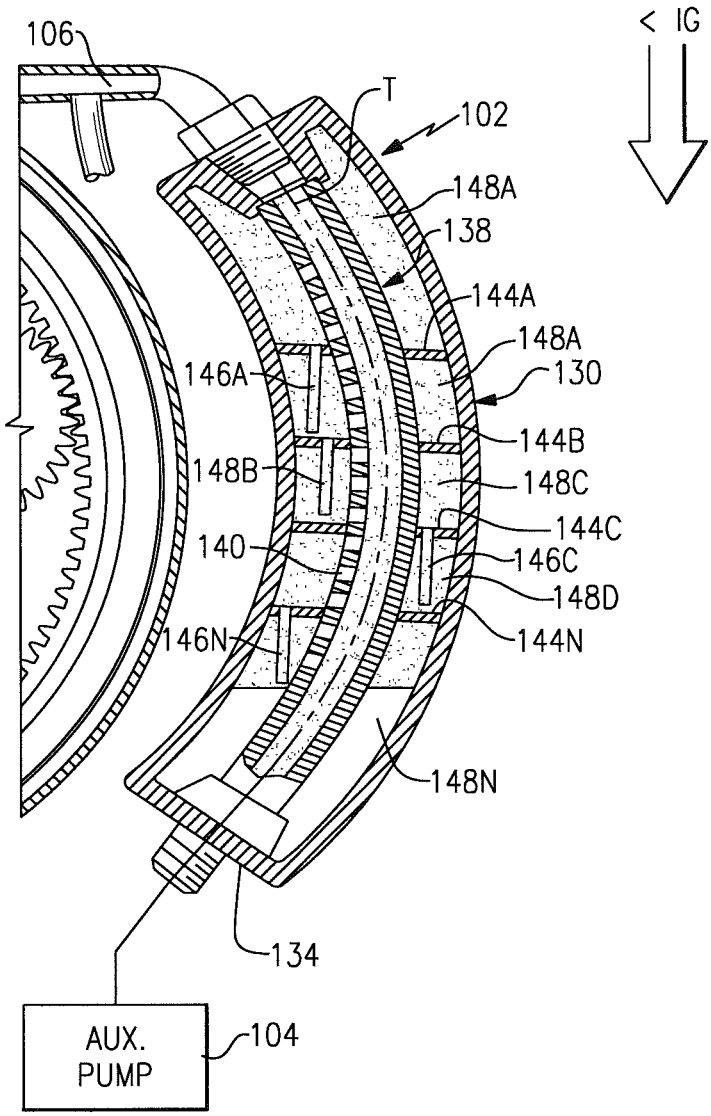
FIG. 9 is an expanded schematic view showing the auxiliary lubricant tank with a segmented anti-back flow structure during an example reduced-G operation.

The walls 144A-144*n* create a multiple of separate compartments 148A-148*n* from which the respective tube 146A-146*n* provides fluid communication between compartments 148A-148*n*. The separate compartments 148A-148*n* permit lubricant flow to fill the compartments 148A-148*n* in normal operation (FIG. 8) yet prevent lubricant from being violently agitated in reduced-G conditions (FIG. 9). That is, for normal operations, lubricant will flow freely from top down and fill the separate compartments 148A-148*n* bottom up. At reduced-G, the walls 144A-144*n* minimize lubricant back flow such that the filled compartments 148A-148*n* remain filled to the level of the multiple of tubes 146A-146*n* (FIG. 9) and the auxiliary lubricant tank discharge passageway 138 may draw lubricant for such that, for example only, the journal pins 70 are prevented from oil starvation at reduced-G conditions (FIGS. 4 and 5).

Figure 10:
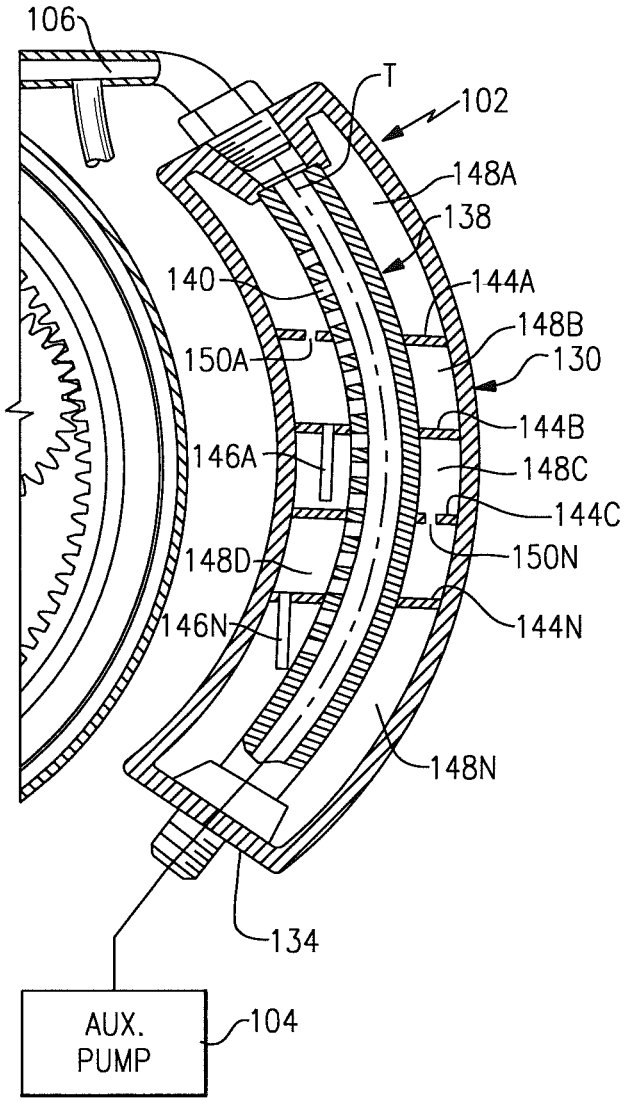
FIG. 10 is an expanded schematic view showing the auxiliary lubricant tank with a segmented anti-back flow structure according to another non-limiting embodiment.

With reference to FIG. 10, in another disclosed, non-limiting embodiment, a multiple of apertures 150A-150*n* may alternatively be utilized within one or more walls 144A-144*n* to slow flow of the lubricant between the multiple of separate compartments 148A-148*n*. The multiple of apertures 150A-150*n* may be provided either alone or in combination with one or more tubes 146A-146*n* to define the compartments 148A-148*n*. The apertures 150A-150*n* facilitate simplification of manufacture as well as reduced lubricant agitation.

The lubricant is encouraged to enter the auxiliary lubricant tank discharge passageway 138 partly due to the decrease in area of the perforations of opening 140 toward the bottom 134, partly due to suction created by the auxiliary pump 104 and partly due to the segmented anti-back flow structure 142. In other words, the separate compartments 148A-148*n* maintain a supply of lubricant within the auxiliary lubricant tank 102 such that the auxiliary lubricant tank discharge passageway 138 is much less likely to "pull air" which may result in lubricant starvation at reduced-G conditions.

For further understanding of other aspects of the auxiliary lubrication system, attention is directed to U.S. Pat. No. 8,020,665, entitled Lubrication System with Extended Emergency Operability which is assigned to the assignee of the instant disclosure and which is hereby incorporated herein in its entirety.

It should be understood that relative positional terms such as "forward," "aft," "upper," "lower," "above," "below," "bottom", "top", and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A lubricant tank, comprising:

a lubricant tank body;

a lubricant tank discharge passageway at least partially within said lubricant tank body; and a segmented anti-back flow structure mounted adjacent to and disposed in said lubricant tank body and adjacent to and in fluid communication with said lubricant tank discharge passageway, wherein said segmented anti-back flow structure includes a multiple of walls each of which includes an outwardly projecting tube which extends therethrough.

2. The lubricant tank as recited in claim 1, wherein each of said tubes extends towards an adjacent lower wall.

3. The lubricant tank as recited in claim 1, wherein each of said tubes extends towards a lower wall of said multiple of walls.

4. A lubricant tank, comprising:

a lubricant tank body;

a lubricant tank discharge passageway at least partially within said lubricant tank body; and a segmented anti-back flow structure mounted adjacent to and disposed in said lubricant tank body and adjacent to and in fluid communication with said lubricant tank discharge passageway, wherein said segmented anti-back flow structure includes a multiple of walls each of which includes a tube which extends therethrough, and wherein at least one of said tubes extends toward a bottom of said lubricant tank body.

5. The lubricant tank as recited in claim 4, wherein each of said multiple of walls surround said lubricant tank discharge passageway.

6. A lubricant tank, comprising:

a lubricant tank body;

a lubricant tank discharge passageway at least partially within said lubricant tank body; and a segmented anti-back flow structure mounted adjacent to and disposed in said lubricant tank body and adjacent to and in fluid communication with said lubricant tank discharge passageway, wherein said segmented anti-back flow structure includes a multiple of walls each of which includes a tube which extends therethrough, and wherein each of said multiple of walls surround said lubricant tank discharge passageway.

7. A lubrication system, comprising:

a main lubricant tank configured to hold lubricant that is communicated from said main lubricant tank to a component along a first communication path;

an auxiliary lubricant tank configured to hold lubricant that is communicated from said component to said auxiliary lubricant tank along a second communication path, said first communication path separate from said second communication path;

an auxiliary lubricant tank discharge passageway at least partially within said auxiliary lubricant tank, said auxiliary lubricant tank discharge passageway, includes an opening to permit lubricant transfer between said auxiliary lubricant tank and said auxiliary lubricant tank discharge passageway; and a segmented anti-back flow structure mounted in said auxiliary lubricant tank and adjacent to said auxiliary lubricant tank discharge passageway, and wherein said auxiliary lubricant tank and said auxiliary lubricant tank discharge passageway are defined along a non-linear axis, and wherein said segmented anti-back flow structure includes a multiple of walls at least one of which includes an outwardly projecting tube which extends therethrough.

8. The lubrication system as recited in claim 7, wherein at least one of said tubes extends toward a bottom of said auxiliary lubricant tank.

9. The auxiliary lubricant tank as recited in claim 7, wherein at least one of said tubes extends towards an adjacent lower wall with respect to a bottom of said auxiliary lubricant tank.

10. A method of reducing lubrication starvation from a lubrication system in communication with a geared architecture for a gas turbine engine comprising:

segmenting an auxiliary lubricant tank defined around an auxiliary lubricant tank discharge passageway.

11. The method as recited in claim 10, further comprising:

segmenting the auxiliary lubricant tank with a multiple of walls at least one of which includes a tube which extends therefrom.

12. The method as recited in claim 11, further comprising:

locating the multiple of walls with respect to a bottom of the auxiliary lubricant tank, each of the tubes directed toward the bottom from a respective wall.

13. The method as recited in claim 10, further comprising:

orienting the auxiliary lubricant tank and the auxiliary lubricant tank discharge passageway along a non-linear axis.

14. The method as recited in claim 13, further comprising:

forming an opening in the auxiliary lubricant tank discharge passageway along an inner radius thereof.

* * * * *